US011213443B2

(12) United States Patent
Paul

(10) Patent No.: US 11,213,443 B2
(45) Date of Patent: Jan. 4, 2022

(54) INDICATION SYSTEM TO IDENTIFY OPEN SPACE BENEATH PATIENT SUPPORT APPARATUS

(71) Applicant: Stryker Corporation, Kalamazoo, MI (US)

(72) Inventor: Anish Paul, Kalamazoo, MI (US)

(73) Assignee: Stryker Corporation, Kalamazoo, MI (US)

( * ) Notice: Subject to any disclaimer, the term of this patent is extended or adjusted under 35 U.S.C. 154(b) by 336 days.

(21) Appl. No.: 16/218,758

(22) Filed: Dec. 13, 2018

(65) Prior Publication Data

US 2019/0201264 A1 Jul. 4, 2019

Related U.S. Application Data

(60) Provisional application No. 62/611,653, filed on Dec. 29, 2017.

(51) Int. Cl.
*A61G 7/012* (2006.01)
*A61G 7/05* (2006.01)
(Continued)

(52) U.S. Cl.
CPC ..... *A61G 7/012* (2013.01); *A61G 7/018* (2013.01); *A61G 7/0524* (2016.11);
(Continued)

(58) Field of Classification Search
CPC ..... A61G 7/012; A61G 7/0524; A61G 7/018; A61G 7/1013; A61G 7/052; A61G 7/0506;
(Continued)

(56) References Cited

U.S. PATENT DOCUMENTS 4,325,061 A 4/1982 Wolar
4,407,030 A 10/1983 Elliott
(Continued)

FOREIGN PATENT DOCUMENTS

WO 0225636 A2 3/2002

OTHER PUBLICATIONS

Stryker, "Modular Patient System (MPS) 3000 Bed Maintenance Manual", 3000-000-020 REV B, Mar. 1994, 249 pages.

*Primary Examiner* — Nicholas F Polito
*Assistant Examiner* — George Sun
(74) *Attorney, Agent, or Firm* — Howard & Howard Attorneys PLLC

(57) ABSTRACT

A patient support apparatus includes a support structure having a base and further includes an indication system having one or more clearance sensors configured to detect clearance within a clearance zone between the patient support surface and a floor surface and are also configured to generate one or more clearance signals corresponding to the detected clearance. The indication system also includes a controller coupled to the clearance sensors that is configured to receive the one or more clearance signals and generate an output based upon the received clearance signals. A display coupled to the controller is configured to receive the generated output and generate a visual clearance indication corresponding to the detected clearance within the clearance zone, or in specific predefined portions of the clearance zone, that is viewable in a viewing area of the display.

14 Claims, 6 Drawing Sheets

(51) Int. Cl.
*A61G 7/10* (2006.01)
*A61G 7/018* (2006.01)

(52) U.S. Cl.
CPC ..... *A61G 7/1013* (2013.01); *A61G 7/052* (2016.11); *A61G 7/0506* (2013.01); *A61G 2203/726* (2013.01)

(58) Field of Classification Search
CPC .... A61G 2203/726; A61G 7/00; A61G 7/002; A61G 7/015; A61G 7/05; A61G 7/0507; A61G 7/0573; A61G 7/08; G01V 8/20; F16P 3/144
See application file for complete search history.

(56) References Cited

U.S. PATENT DOCUMENTS 4,534,077 A 8/1985 Martin
5,069,000 A 12/1991 Zuckerman
5,156,166 A 10/1992 Sebring
5,220,698 A 6/1993 Hannant
5,317,769 A 6/1994 Weismiller et al.
5,481,769 A 1/1996 Schneider
6,201,481 B1 3/2001 Bellingroth
6,555,982 B2 4/2003 Tyckowski
6,652,033 B2 11/2003 Satoh
6,677,720 B2 1/2004 Fraser
7,368,704 B2 * 5/2008 Dean ..... G01V 8/10 250/221
7,472,437 B2 1/2009 Riley et al.
7,676,866 B2 3/2010 Toms et al.
7,834,768 B2 11/2010 Dixon et al.
7,914,076 B2 3/2011 Broering et al.
7,926,131 B2 4/2011 Menkedick et al.
7,978,084 B2 7/2011 Dixon et al.
8,039,766 B2 10/2011 Flanagan
8,134,473 B2 3/2012 Roussy
8,256,048 B2 9/2012 Bly et al.
8,258,944 B2 9/2012 Riley et al.
8,502,663 B2 8/2013 Riley et al.
8,514,093 B2 8/2013 Roussy
8,866,610 B2 10/2014 Riley et al.
8,959,681 B2 2/2015 Richards
9,009,893 B2 4/2015 Kramer et al.
9,182,750 B2 11/2015 Rawls-Meehan
9,228,885 B2 1/2016 Zerhusen et al.
9,517,171 B2 12/2016 Andersen et al.
9,655,796 B2 5/2017 Riley et al.
2006/0010601 A1 * 1/2006 Riley ..... H01H 3/16 5/600
2007/0157385 A1 * 7/2007 Lemire ..... A61G 7/0509 5/600
2007/0164200 A1 * 7/2007 Fischereder ..... B30B 15/285 250/221
2009/0119843 A1 * 5/2009 Rodgers ..... A61B 5/1123 5/611
2012/0117732 A1 * 5/2012 O'Keefe ..... A61G 7/0506 5/613
2012/0137439 A1 * 6/2012 Heimbrock ..... A61G 7/0514 5/618
2014/0076644 A1 * 3/2014 Derenne ..... A61G 1/0287 180/19.2
2014/0310876 A1 * 10/2014 Roussy ..... A61G 7/07 5/613
2014/0352067 A1 12/2014 Riley et al.
2015/0224005 A1 8/2015 Kramer et al.
2015/0323388 A1 * 11/2015 Kostic ..... A61G 7/0528 250/338.1
2016/0166453 A1 6/2016 Furman et al.
2016/0193095 A1 7/2016 Roussy et al.
2017/0143565 A1 5/2017 Childs et al.
2017/0172828 A1 * 6/2017 Zerhusen ..... A61G 7/05776
2017/0172829 A1 6/2017 Tessmer et al.
2017/0202717 A1 7/2017 Andersen et al.

* cited by examiner

INDICATION SYSTEM TO IDENTIFY OPEN SPACE BENEATH PATIENT SUPPORT APPARATUS

CROSS-REFERENCE TO RELATED APPLICATIONS

This application is a U.S. Non-provisional Patent Applications of and claims priority to U.S. Provisional Patent Application 62/611,653, filed Dec. 29, 2017, which is hereby incorporated by reference in its entirety.

BACKGROUND

Patient support systems facilitate care of patients in a health care setting. Patient support systems comprise patient support apparatuses such as, for example, hospital beds, stretchers, cots, tables, wheelchairs, and chairs. Conventional patient support apparatuses comprise a base, a support frame, and a patient support surface upon which the patient is supported. Often, these patient support apparatuses have one or more powered devices to perform one or more functions on the patient support apparatus. These functions can include lifting and lowering the patient support surface, articulating the patient support surface, and the like. When the caregiver wishes to operate a powered device to perform a function, the caregiver actuates a user input device, often in the form of a button on a control panel.

In certain scenarios, the caregiver wishes to position an object such as an over the bed table ("OBT") such that its legs are underneath the base of the patient support apparatus. However, unless the caregiver physically bends down to visualize the clearance beneath the base of the patient support apparatus, the caregiver cannot be certain as to whether there is sufficient clearance to ensure no physical contact between the legs of the OBT and a portion of the patient support apparatus.

Alternatively, when the caregiver is operating one of the powered devices, such as a lift mechanism for raising or lowering the patient support surface, their field of vision is limited by their perspective relative to the patient support apparatus. As such, the caregiver cannot visualize the clearance space beneath the patient support surface without bending down to view the clearance or otherwise changing their positioning to view the clearance space. Thus, for example, when an object such as the OBT or a patient lift are positioned such that its legs are fully or partially beneath the base of the patient support apparatus, operation of the lift mechanism to lower the patient support surface could result in contacting the object. Such contact could result in damage to the patient support apparatus or the object, or both.

A patient support apparatus designed to overcome one or more of the aforementioned challenges is desired.

DETAILED DESCRIPTION

Figure 1A:
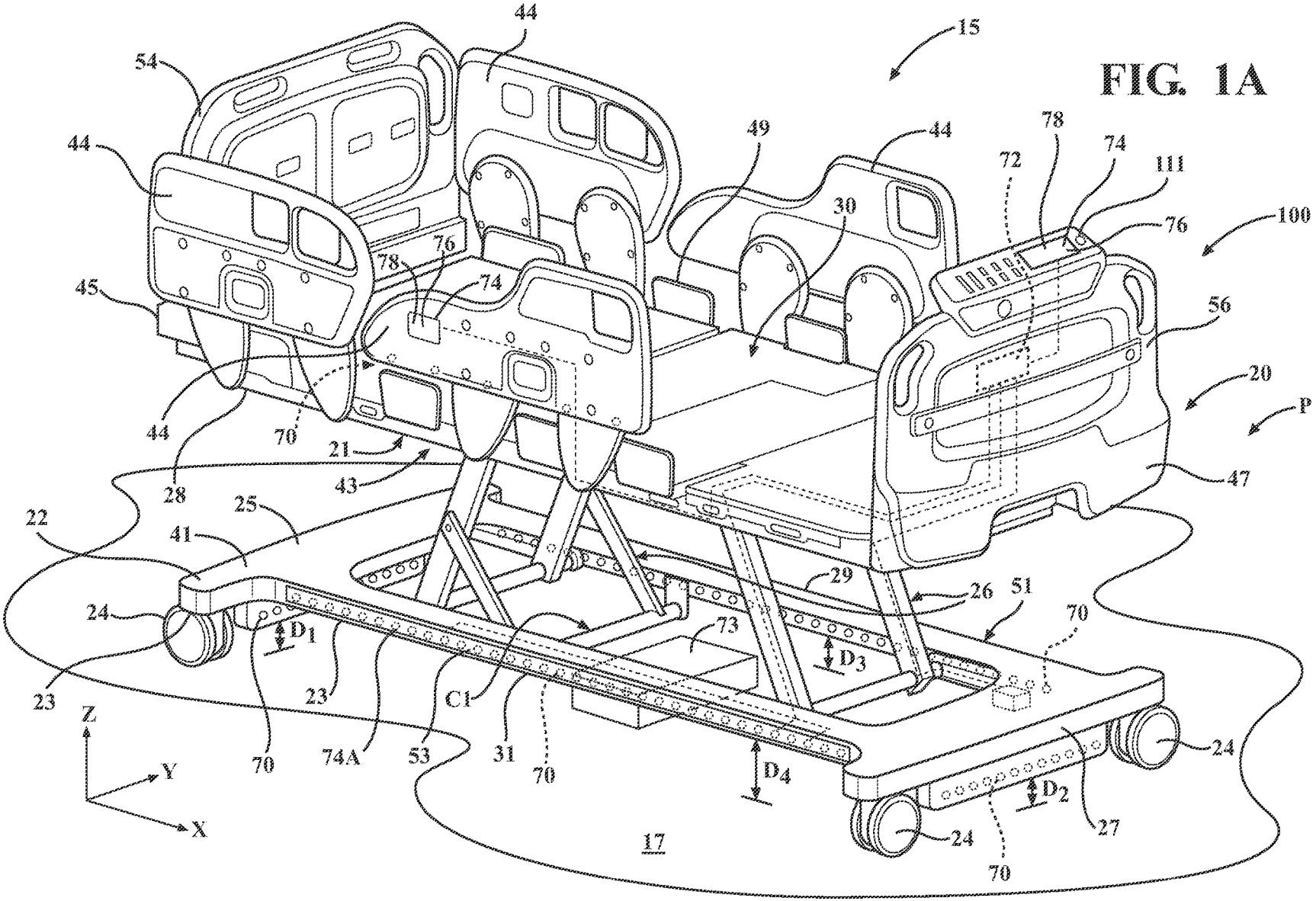
FIG. 1A is perspective view of a patient support apparatus having a clearance indication system and including an object disposed beneath a base of the patient support apparatus.
Figure 1B:
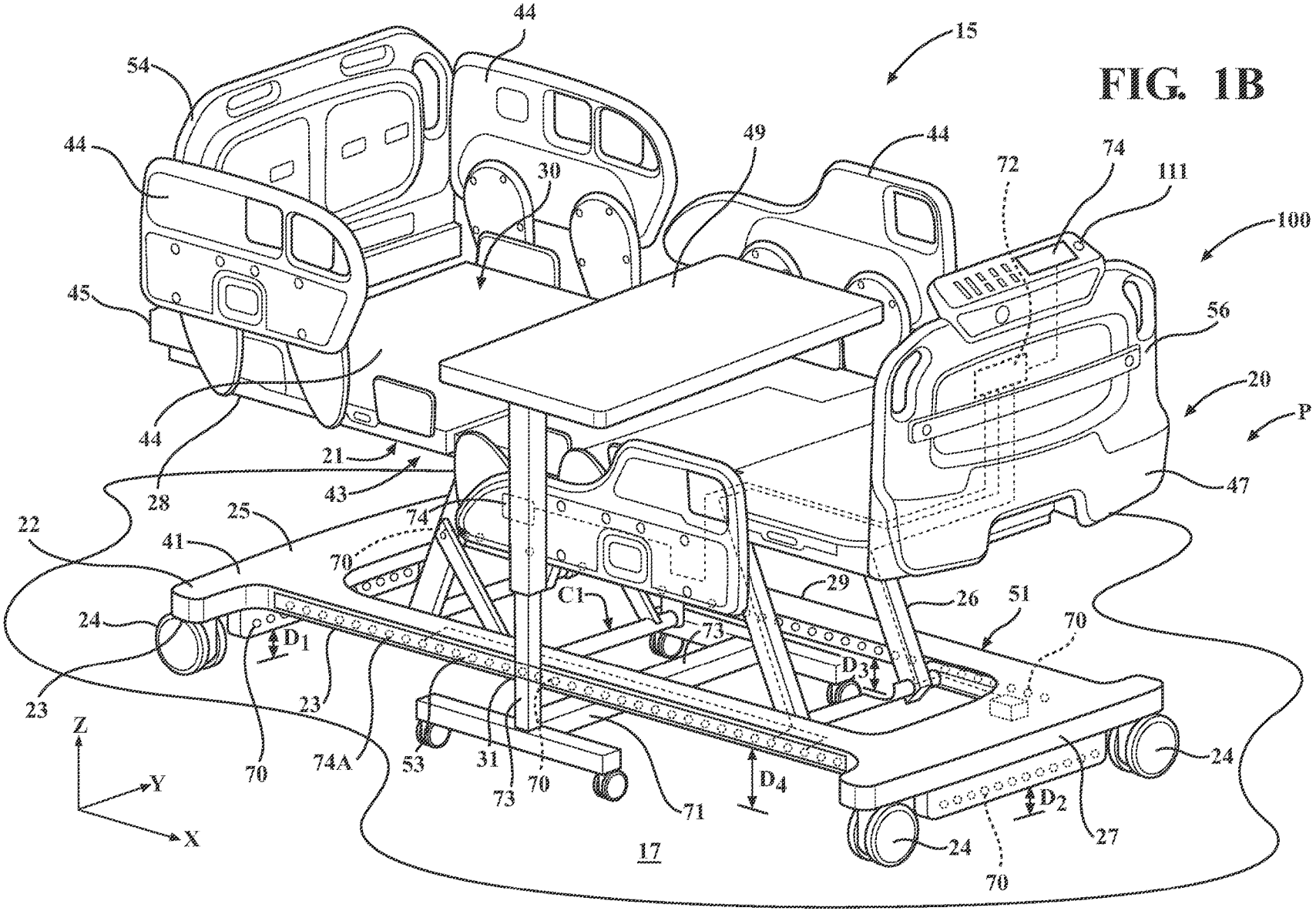
FIG. 1B is perspective view of the patient support apparatus of FIG. 1A including an over the bed table disposed beneath the base of the patient support apparatus.

Referring to FIGS. 1A and 1B, a patient support apparatus 15 having a clearance indication system 100 according to one embodiment is shown. The patient support apparatus 15 illustrated in FIGS. 1A and 1B is a hospital bed. In other embodiments, however, the patient support apparatus 15 may be a stretcher, cot, table, wheelchair, chair, or similar apparatus.

In general, the patient support apparatus 15 includes a base 22, a frame or litter 28 supported by the base 22, and a patient support deck 30 supported on an upper surface of the frame 28. The frame 28 also includes a lower surface 21 opposite the upper surface. The frame 28 and/or the patient support deck 30 provide a patient support surface 43 upon which the patient is supported. The patient support apparatus 15 further includes a headboard 54 and a footboard 56. Collectively, the base 22, frame 28 and support deck 30 may also be referred to hereinafter as the support structure 20.

The patient support apparatus 15 also includes one or more lift mechanisms 26 that are adapted to raise and lower the frame 28 with respect to the base 22. These lift mechanisms 26 may be hydraulic actuators, electric actuators, or any other suitable device for raising and lowering the frame 28 with respect to the base 22. In some embodiments, lift mechanisms 26 are operable independently so that the orientation of the frame 28 with respect to the base 22 can also be adjusted.

In the embodiments shown in FIGS. 1A and 1B, the patient support apparatus 15 includes a plurality of wheels 24 coupled to the base 22. The wheels 24, when utilized, are coupled to a bottom surface 23 of the base 22 and are configured to facilitate transport over floor surfaces. The wheels 24 are arranged in each of four quadrants of the base 22 adjacent to corners of the base 22. In certain embodiments, the wheels 24 are caster wheels able to rotate and swivel relative to the patient support deck 30 during transport. In addition, in some embodiments, the wheels 24 are not caster wheels and may be non-steerable, steerable, non-powered, powered, or combinations thereof. Additional wheels are also contemplated. For example, the patient support apparatus 15 may comprise four non-powered, non-steerable wheels, along with one or more powered wheels. In embodiments including wheels 24, the base 22 also includes a brake (not shown) that is adapted to selectively lock and unlock the wheels 24 so that, when unlocked, the patient support apparatus 15 may be wheeled to different locations.

In alternative embodiments (not shown), the patient support apparatus 15 does not include wheels 24 that are coupled to the bottom surface 23 of the base 22, but instead includes footers (not shown) that are coupled to, or integrally formed with, the base 22 and between the bottom surface 23 and the floor surface 17 on which the patient support apparatus 15 is placed.

The frame 28 provides a structure for supporting the patient support deck 30. The patient support deck 30 is adapted to provide an upper surface on which a mattress (not shown), or other soft cushion is positionable so that a patient may lie and/or sit thereon. The mattress or cushion may provide a secondary patient support surface on which to support the patient. In some embodiments, the mattress may be omitted. The patient support deck 30 is made of a plurality of sections, some of which are pivotable about generally horizontal pivot axes.

A plurality of side rails 44 may also be coupled to frame 28 or to the patient support deck 30. If the patient support apparatus 15 is a bed, there may be four such side rails 44, one positioned at a left head end of the patient support deck 30, a second positioned at a left foot end of frame 28, a third positioned at a right head end of the patient support deck 30, and a fourth positioned at a right foot end of frame 28. If patient support apparatus 15 is a stretcher or a cot, there may be fewer side rails. In other embodiments, there may be no side rails 44 on patient support apparatus 15. Regardless of the number of side rails 44, such side rails 44 are movable to a raised position (as shown in FIG. 1A) in which they block ingress and egress into and out of patient support apparatus 15, a lowered position (one of the side rails 44 is shown in the lowered position in FIG. 1B) in which they are not an obstacle to such ingress and egress, and one or more intermediate positions therebetween.

The construction of any one of the lift mechanism 26, the frame 28, the patient support deck 30, the side rails 44, the footboard 56 and the headboard 54 may take on any known or conventional design other than as illustrated in FIGS. 1A and 1B.

Figure 2:
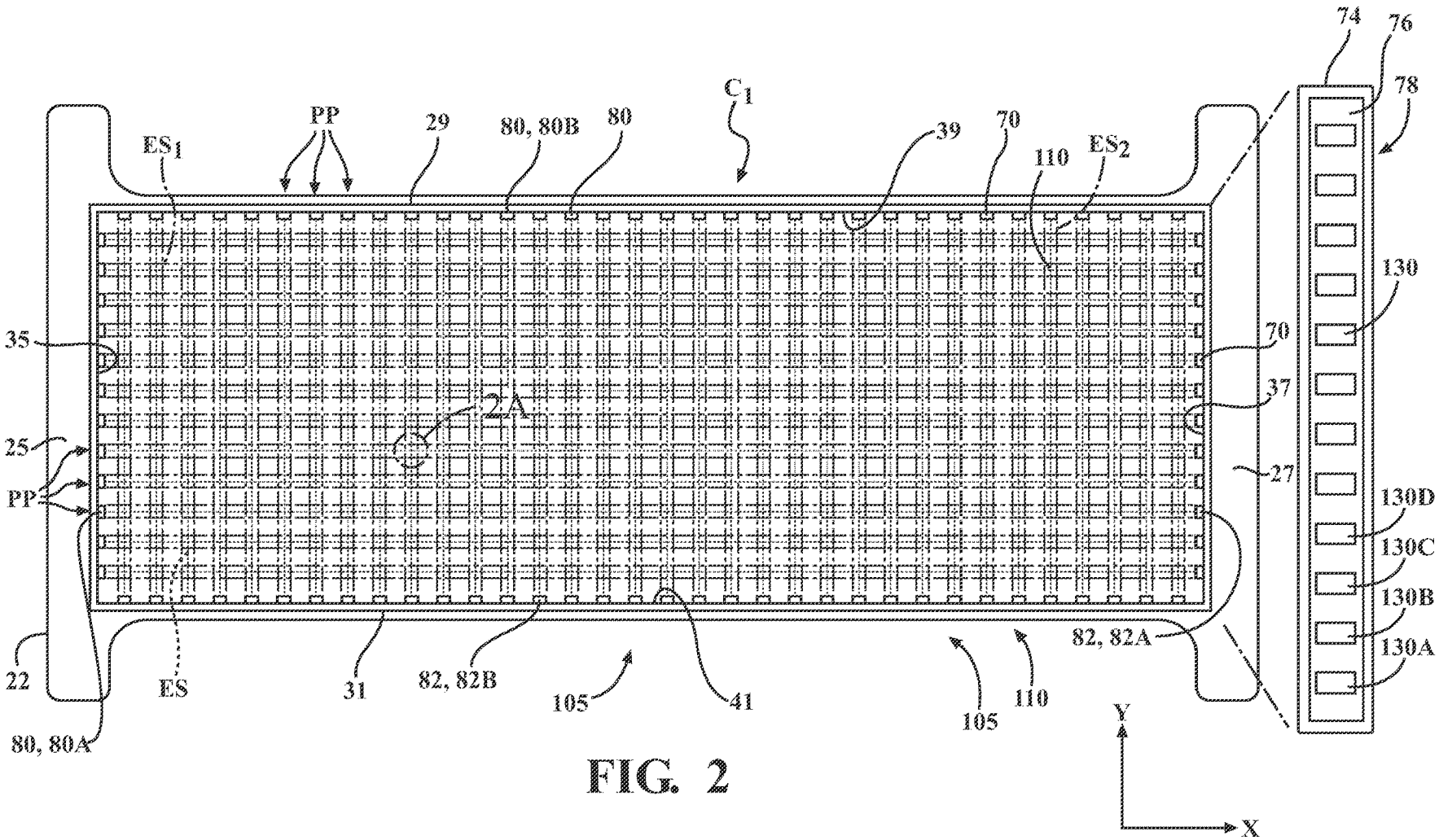
FIG. 2 is a top perspective view of the base and a display of the patient support apparatus of FIGS. 1A and 1B, with the base having a plurality of clearance sensors according to one embodiment and illustrating a grid of emitted signals corresponding to the plurality of clearance sensors.

As best shown in FIG. 2, the base 22 includes a head section 25, an opposing foot section 27, and a pair of opposing side sections 29, 31 that each separately connect the head section 25 to the opposing foot section 27. These sections 25, 27, 29, 31 may be formed as a single integral piece, or alternatively may be formed from tubing (such as square tubing) that are welded together to form the base 22. Each of the head section 25, foot section 27, side section 29 and side section 31 includes the afore-mentioned bottom surface 23 facing the floor surface 17 and a top surface 41 opposite the bottom surface 23 facing in a direction towards the frame 28.

As also illustrated in FIG. 2, each of the head section 25 and foot section 27 separately extend in a generally lateral direction between the corners of the base 22 (i.e., the length of the head section 25 between the corners extends in a generally lateral direction, as does the length of the foot section 27), wherein the opposing side sections 29, 31 extend in a generally longitudinal direction between the corners of the base 22 (i.e., the length of the first side section 29, and the length of the second side section 31, each respectively extend in a generally longitudinal direction between the corners and are generally normal or perpendicular to the length of the head section 25 and foot section 27). The terms "lateral direction" and "longitudinal direction", as used herein, refer to directional relationships relative to the specified structures of the base 22. In this regard, the lateral direction as defined herein may alternatively be referred to as the "y-direction", whereas the longitudinal direction as defined herein may alternatively be referred to as the "x-direction." For ease of description, the x-, y- and z-direction are labelled on FIGS. 1A and 1B, while the x- and y-direction are labelled on FIG. 2.

As noted above, the base 22 includes the bottom surface 23 along the bottom of each of the head section 25, foot section 27, and opposing side sections 29, 31. A base clearance distance D1, D2, D3, and D4 is defined between the bottom surface 23 of the respective head section 25, foot section 27, side sections 29, 31, respectively, and the floor surface 17.

The base clearance distance D3, D4, of the opposing side sections 29, 31 is preferably sufficiently large such that legs 71 of an object 73 (shown as an OBT in FIG. 1B, or alternatively a patient lift (not shown)), can be inserted between the bottom surface 23 and the floor surface 17. In certain embodiments, the base clearance distance D3 is the same as the base clearance distance D4.

The base clearance distance D1 of the head section 25, in certain embodiments, is the same as the base clearance distance D2 of the foot section 27. In further embodiments, the base clearance distance D1, and/or D2, is the same as, or different than, the base clearance distances D3 and D4 of the opposing side sections 29, 31. In still further embodiments, the base clearance distance D1, and/or D2, is less than the base clearance distances D3 and D4 of the opposing side sections 29, 31.

Referring back to FIGS. 1A and 1B, the frame 28 includes a head end 45, a foot end 47, and a pair of opposing side ends 49 that define an outer periphery P between the upper surface and the lower surface 21 and correspond generally in position above the head section 25, foot section 27, and pair of opposing side sections 29, 31, respectively, of the base 22.

The volume between the patient support surface 43 and the floor surface 17 defines a clearance zone C1 therebetween extending in a generally vertical, or z-direction (as shown in FIGS. 1A and 1B) and is defined in an x-direction and y-direction by the border of the support structure 20 when viewed from above. The clearance zone C1 may preferably further be defined in a x-direction and y-direction (i.e., a longitudinal or lateral direction) as being bordered by the inner surfaces 35, 37, 39 and 41 of the base 22 (See FIG. 2). As described further herein, the clearance zone C1 could alternatively or additionally comprise a volume defined beneath the patient support deck 30, beneath the frame 28, beneath the base 22, and/or a volume between any component of the patient support apparatus 15 and the floor surface 17. In some versions, the clearance zone C1 could also encompass volumes outside of the lateral periphery of the patient support surface 43 and/or volumes generally external to the patient support apparatus 15.

As noted above, the patient support apparatus 15 further includes an indication system 100. The indication system 100 is used to detect clearance within the clearance zone C1 and to generate a visual clearance indication corresponding to the detected clearance within the clearance zone C1 that is viewable by a caregiver or an individual in proximity to the patient support apparatus 15.

Figure 8:
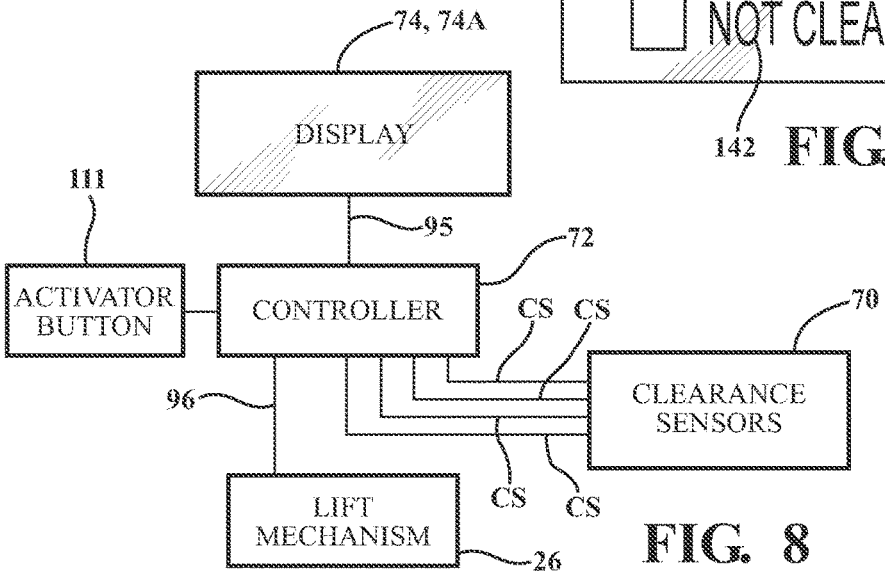
FIG. 8 is a schematic diagram of electrical connections between a controller and each of a lift mechanism, the display, and the plurality of clearance sensors of the patient support apparatus of FIGS. 1A and 1B.

The indication system 100 includes one or more clearance sensors 70 that are each respectively coupled to a controller 72 (See FIG. 8). A display 74 is also separately coupled to the controller 72. The display 74 includes a viewing area 76 (see, e.g., FIG. 1A) visible to a caregiver or individual in proximity to the patient support apparatus 15. The lift mechanism 26 is also preferably separately coupled to the controller 72.

The controller 72 has one or more microprocessors for processing instructions or for processing an algorithm stored in memory to control operation of the display 74, the lift mechanism 26, and/or other powered devices on the patient support apparatus 15. Additionally or alternatively, the controller 72 may comprise one or more microcontrollers, field programmable gate arrays, systems on a chip, discrete circuitry, and/or other suitable hardware, software, or firmware that is capable of carrying out the functions described herein. The controller 72 may be carried on-board the patient support apparatus 15, or may be remotely located. In one embodiment, the controller 72 is coupled to the base 22. In other embodiments, the controller 72 is coupled to the headboard 54 or footboard 56. As shown in FIGS. 1A and 1B, the controller 72 is coupled to the footboard 56 in accordance with one embodiment.

The controller 72 may comprise one or more subcontrollers configured to control all the powered devices or one or more subcontrollers for each of the powered devices. Power to the powered devices and/or the controller 72 may be provided by a battery power supply or an external power source.

The controller 72 is coupled to the clearance sensors 70 and the powered devices in a manner that allows the controller 72 to control the powered devices. The controller 72 may communicate with the clearance sensors 70 and the powered devices via wired or wireless connections. The controller 72 receives signals from the clearance sensors 70 and generates and transmits control signals to the powered devices, or components thereof, to operate their associated actuators, display drivers, control their pumps, control their valves, or otherwise cause the powered devices to perform one of more of the desired functions.

In operation, and as will be described in more specific detail with respect to each of the embodiments below, each one of the one or more clearance sensors 70 (See FIG. 2 or FIG. 3) are configured to detect clearance with the clearance zone C1 and to generate a clearance signal corresponding to the detected clearance. Such detection may be done in a continuous fashion, or upon actuation of the display 74 by the caregiver or operator. The generated clearance signal is then received by the controller 72, which generates an output based upon the received one or more clearance signals. The display 74 receives the output from the controller 72, and generates a visual clearance indication 78 within the viewing area 76 that is viewable by the caregiver or individual. This generated visual clearance indication 78 provides the caregiver or individual information as to whether an object 73 is present within the clearance zone C1 without having the bend over and view the space beneath the base 22 and/or frame 28 of the patient support apparatus 15.

The one or more clearance sensors 70 are coupled to, positioned along, fixedly coupled to, or are otherwise integrally formed with the support structure 20 and are configured to detect clearance within the entirety of the clearance zone C1, or within a specific portion of the clearance zone C1. In addition, each one of the one or more clearance sensors 70 is also configured to generate a clearance signal corresponding to its respected detected clearance. Accordingly and collectively, the one or more clearance sensors 70 are therefore configured to generate one or more clearance signals corresponding to the detected clearance.

Figure 3:
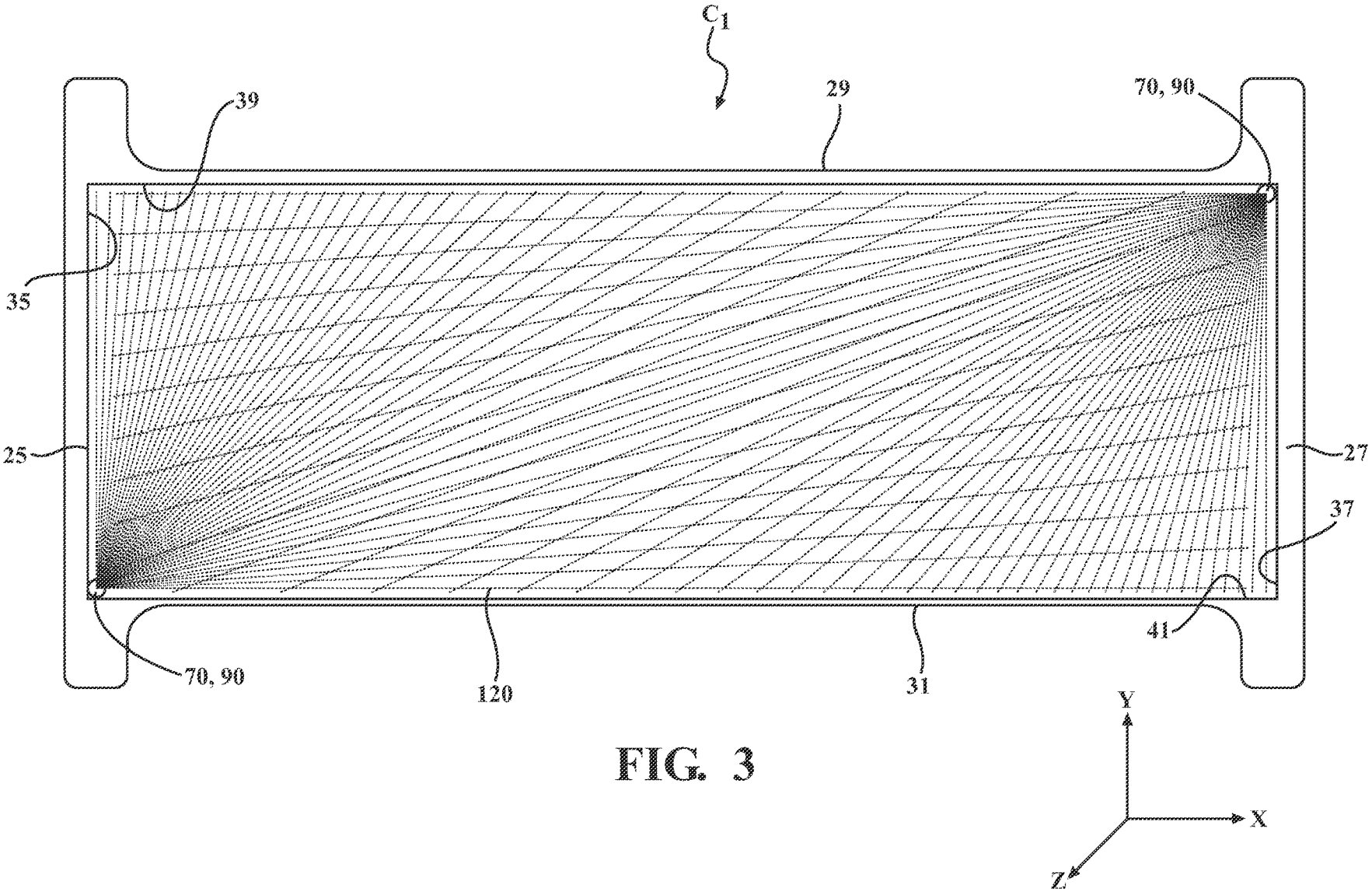
FIG. 3 is a top view of the base of the patient support apparatus of FIGS. 1A and 1B having a plurality of clearance sensors according to another embodiment and illustrating a grid of received light received by each of the corresponding to the plurality of clearance sensors.

In one embodiment (shown in FIGS. 1A, 1B and 2), the one or more clearance sensors 70 are coupled to the inner surface 35, 37, 39, 41 of each of the head section 25, the foot section 27, the side section 29, and the side section 31 of the base 22. In an alternative embodiment, as shown in FIG. 3, the one or more clearance sensors 70 are coupled along one or more corners that are respectively defined at the ends of a respective pair of the inner surfaces (35, 39; 35, 41; 37, 39; or 37, 41) of the base 22. In still further alternative embodiments (not shown), the one or more sensors 70 may be coupled to at least one, but less than all four, of the respective inner surface 35, 37, 39, 41 of the base 22. In these embodiments, the one or more sensors 70 are preferably positioned on the respective inner surface 35, 37, 39, 41 of the base 22 so as to detect clearance within the clearance zone C1. Other arrangements of the clearance sensors 70 are contemplated.

The clearance sensors 70 utilized can be in many forms known to those of skill in the art that are capable of detecting clearance within the desired clearance zone C1.

In certain embodiments, such as shown in FIG. 2, each of the clearance sensors 70 includes an emitter 80 and an associated detector 82 that are respectively coupled to the inner surface 35, 37, 39 and/or 41 of one or more of the head section 25, the foot section 27, the side section 29, and/or the side section 31. In these embodiments, the emitter 80 is configured to generate a signal ES, and in certain embodiments a wireless signal, that is detected by its associated detector 82. The type of signal generated by the emitter 80 varies depending upon the type of emitter/detector system utilized, but can be in the form of an optical signal, such as an infrared light (IR) signal or a signal from another form of electromagnetic radiation, including but not limited to ultrasonic, radar, and microwave signals. The associated detector 82 is configured to receive the type of generated signal from its associated emitter 80.

The signal ES that is generated from the emitter 80 travels within a predefined portion PP of the clearance zone C1 and is received by the associated detector 82 when there is no object 73 present between the emitter 80 and its associated detector 82 in the predefined portion PP that interrupts or otherwise alters the generated signal ES as detected by the detector 82. The predefined portion PP of the clearance zone C1, corresponding to the emitted signal ES, is a three-dimensional volume having a predefined length, a predefined width, and a predefined height.

Upon receipt of the emitted signal ES, the associated detector 82 generates a clearance signal CS corresponding to the detected clearance. More specifically, the detector 82 generates a clearance signal CS when the emitted signal ES is received in full from the emitter 80, which indicates that an object 73 is not present within the predefined portion PP of the clearance zone C1 between the emitter 80 and its associated detector 82 so as to block or otherwise interrupt the signal ES from the emitter 80 to its associated detector 82. In further embodiments, the detector 82 may also be configured to generate a partial clearance signal when the emitted signal ES is received in part from the emitter 80, which indicates that an object 73 is present in the predefined portion PP of the clearance zone C1 but is not positioned to block the entire signal ES from being received by its associated detector 82. In further embodiments, the detector may also be configured to generate a signal when the emitted signal ES is not received from the emitter 80, which indicates that an object 73 is present within the predefined portion PP of the clearance zone C1 and fully blocks or interrupts the signal ES from the emitter 80 to its associated detector 82. The clearance signal CS is sent to the controller 72 for further processing, as will be described further below.

The clearance signals CS generated by the one or more detectors 82 are received by the controller 72 that is electrically connected to the detectors 82. A processing unit (not shown) within the controller 72 continually processes the sent clearance signals CS into data, typically in the form an output 95. This data, or output 95, is received by the display 74 which processes the output 95 and generates the visual clearance indication 78 that can be displayed within the viewing area 76 of the display 74 in a manner that is beneficial to caregiver or individual viewing the generated visual clearance indication 78.

In the embodiment illustrated in FIG. 2, a plurality of emitters 80A are each respectively coupled to the inner surface 35 of the head section 25 of the base 22, while a corresponding plurality of associated detectors 82A are coupled to the inner surface 37 of the foot section 27 of the base 22. An additional plurality of emitters 80B are each respectively coupled to an inner surface 39 of the side section 29 of the base 22, while a corresponding plurality of associated detectors 82B are coupled to the inner surface 41 of the opposing side section 31 of the base 22.

In this embodiment, the emitted signal ES1 from each emitter 80A is defined in the x-direction by the length L1 from the inner surface 35 of the head section 25 to the inner surface 37 of the opposing foot section 27. Further, the emitted signal ES1 has a predetermined width W1 and height H1 (shown best in FIG. 2A) corresponding generally to the respective width and height of the emittance area of respective emitter 80A (emittance area shown exaggerated for illustrative purposes). As illustrated, the signal ES1 is in the general form therefore of a rectangle extending in the x-direction having a width W1, height H1, and a length L1. Similarly, the emitted signal ES2 from each emitter 80B is defined in the y-direction by the width W2 from the inner surface 39 of the side section 29 to the inner surface 41 of the opposing side section 31. Further, the emitted signal ES2 has a predetermined length L2 and height H2 (shown best in FIG. 2A) corresponding generally to the respective length and height of the emittance area of the respective emitter 80B. As illustrated, the signal ES2 is in the general form therefore of a rectangle extending in the y-direction having a width W2, height H2, and a length L2. Of course, the emitters may emit light or other signals in a manner that defines other shapes of emittance areas. The rectangular shapes shown herein are merely for illustration, but generally define the predefined portions PP of the clearance zone C1 being monitored by each of the respective emitter 80A, 80B and detector 82A, 82B pairs.

Figure 2A:
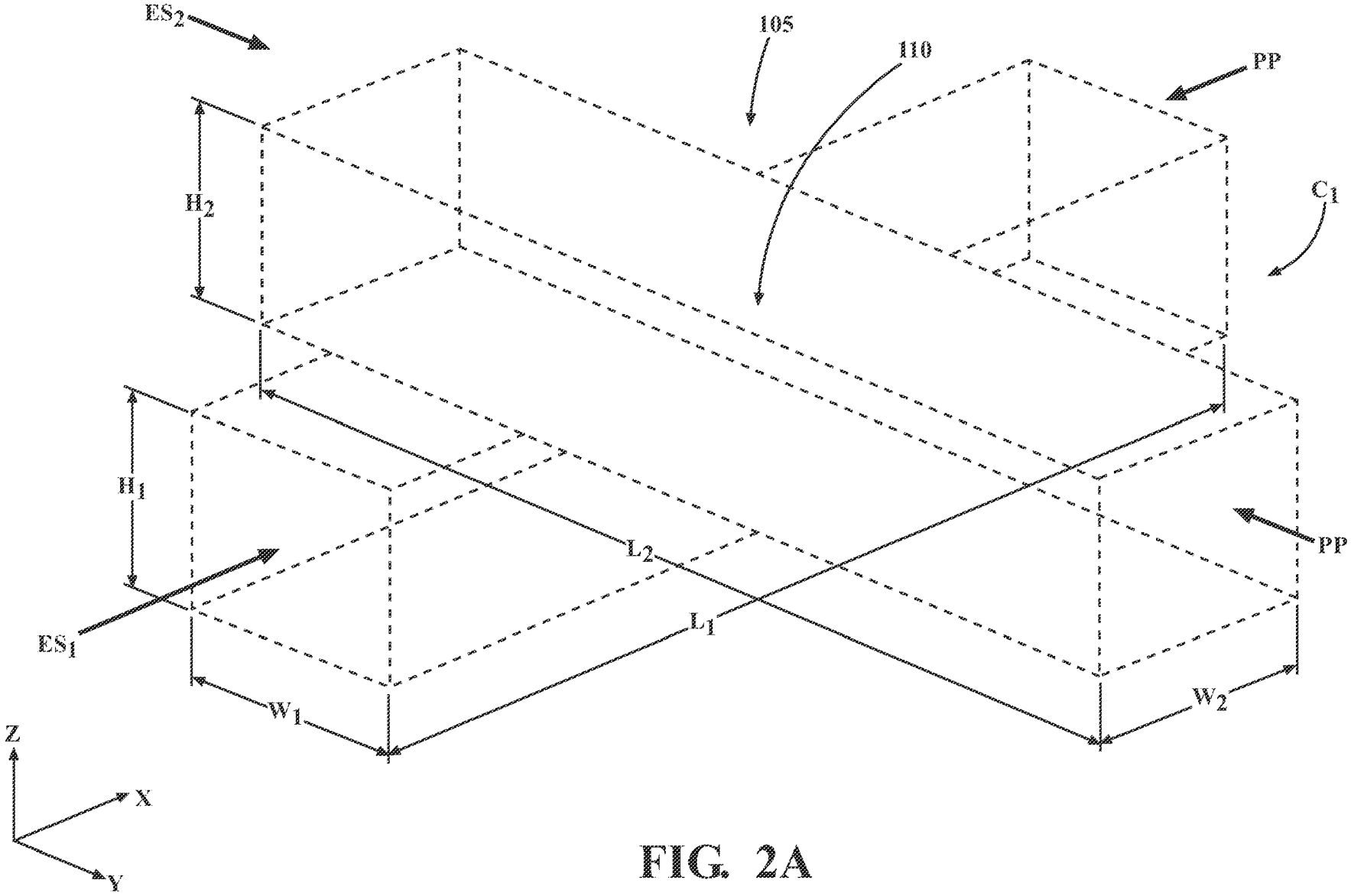
FIG. 2A is a close-up and three dimensional perspective view of a portion of the gridlines of the emitted signals ES1 and ES2 of FIG. 2.

Accordingly, as shown in FIG. 2, a grid 105 of signals ES1 (in the x-direction) and ES2 (in the y-direction) is developed within the clearance zone C1, with the signals ES1 and ES2 defining a plurality of intersecting zones 110 when viewed from above (i.e., when viewed in the z-direction). As illustrated best in FIG. 2A, because the positioning of the pairs of emitters 80A/detectors 82A in FIGS. 1A and 1B are closer to the floor surface 17 than the corresponding positioning of the pairs of emitters 80B/detectors 82B, the respective signals ES1 and ES2 corresponding to a single intersecting zone 110 may not intersect each other, or may partially intersect each other. Accordingly, as shown in FIG. 2A, the volume of the emitted signal ES2 extending in the y-direction is positioned above the volume of the emitted signal ES1, relative to the z-direction, as illustrated, but still collectively define an intersecting zone 110 as provided herein. Accordingly, an object 73 located within the clearance zone C1 corresponding to a single one of the intersecting zones 110 may be detected by a corresponding single detector 82A corresponding to a single emitted signal ES1, or by a single detector 82B corresponding to a single emitted signal ES2, or by both of the single detectors 82A and 82B corresponding to the single intersection zone 110, depending upon the object's height relative to the floor surface 17 in the z-direction.

Of course, in further embodiments (not shown), wherein the pairs of emitters 80A/detectors 82A in FIGS. 1A and 1B and the corresponding pairs of emitters 80B/detectors 82B are all positioned equidistant from the floor surface 17, the respective signals ES1 and ES2 corresponding to a single intersecting zone 110 fully intersect one another. Accordingly, in this scenario, an object 73 located within the clearance zone C1 corresponding to the single one of the intersecting zones 110 may be detected by both of the single detectors 82A and 82B corresponding to the single intersection zone 110.

In further embodiments, such as shown in FIG. 3, the clearance sensor 70 is a camera 90 that is capable of receiving light transmission in a desired range of wavelengths and includes equipment to capture the light transmissions and convert the captured light transmissions to the clearance signal CS. Exemplary cameras 90 that can be used include, but are not limited to, visible light cameras and infrared light cameras.

As opposed to sending out emitted signals ES in the manner of the emitters 80 described above, the cameras 90 are positioned such that they are capable of receiving light transmissions within the clearance zone C1, as represented by the dashed lines 120 illustrated in FIG. 3. The camera 90 processes the received light transmissions 120, and generates a clearance signal CS corresponding to the received light transmissions, with the clearance signal CS being received by the controller 72 in the manner described above. As described above, the processing unit within the controller 72 continually processes the sent clearance signals CS into data, typically in the form of an output 95. This data, or output 95, is received by the display 74 which processes the output and generates the visual clearance indication 78 that can be displayed in the viewing area 76 of the display 74 in a manner that is beneficial to caregiver or individual viewing the generated visual clearance indication 78. In this embodiment, the visual clearance indication 78 may be in the form of a visual image, such as a digital image or video image that is viewable within the viewing area 76 of the display 74.

As noted above, the indication system 100 also includes the display 74 that generates the visual clearance indication 78 that is viewable in the viewing area 76 by a caregiver or individual.

The display 74 may be coupled to any portion of the patient support apparatus 15, preferably in a position that is easily viewable by a caregiver or individual in close proximity to the patient support apparatus 15 or operating the patient support apparatus 15. Accordingly, the display 74 may be coupled to any portion of the support structure 20 that is easily viewable by a caregiver or individual. For example, as illustrated in FIGS. 1A and 1B, one display 74 is coupled to the footboard 56. However, in further embodiments not illustrated, the display 74 could alternatively be coupled to the headboard 54, one of the side rails 44, the base 22, or any other portion of the support structure 20 viewable by a caregiver or individual (including the frame 28). In particular, it is envisioned that one or more displays 74 could be coupled to an outer surface 51, 53 of one of the side sections 29 or 31 of the base 22, with the outer surface 51, 53 defined opposite the respective inner surface 39, 41.

In still further embodiments, multiple displays 74, 74A may be included on the patient support apparatus 15 at varying locations. Thus, for example, one display 74 may be included on the footboard 56 as illustrated in FIGS. 1 and 2, while a second display 74A may be included on the headboard 54, or on a side rail 44, or on the exterior surface of the base 22. For illustrative purposes, and by way of example as shown in FIGS. 1A and 1B, a second display 74A is illustrated as being coupled to the outer surface 53 of the side 31 of the base 22.

In these embodiments, and as referred to schematically in part in FIG. 8, the general method for generating the visual clearance indication 78 is as follows. First, the one or more clearance sensors 70 are used to detect clearance within the clearance zone C1. The term "detect clearance" and the associated "detected clearance", as provided herein, encompasses both the detection of an object 73 within the clearance zone C1 and also the lack of detection of an object 73 in the clearance zone C1 (i.e., wherein the clearance zone C1 is free from objects 73). As noted above, with respect to embodiments wherein the clearance sensors 70 include an emitter 80 and detector 82, the "detected clearance" refers to the emitted signal ES received by the detector 82 from its associated emitter 80 that is different based upon the presence, or absence, of an object 73 located along the emitted signal pathway from the emitter 80 to its associated detector 82. In embodiments wherein the clearance sensor 70 is a camera 90, the "detected clearance" refers to the captured light transmissions from the clearance zone C1 that is different based upon the presence, or absence, of an object 73 in the clearance zone C1.

Next, each one of the one or more clearance sensors 70 generates a respective clearance signal CS corresponding to the detected clearance. In other words, the one or more clearance sensors 70 are configured in a manner that allows a different clearance signal CS to be sent based upon the detected clearance, which again is based upon the presence or absence of an object 73 in the clearance zone C1

Next, the one or more clearance signals CS generated by the clearance sensors 70 are received by the controller 72, typically via an electrical connection between each of clearance sensors 70 and the controller 72. The processing unit (not shown) within the controller 72 continually processes the sent clearance signals CS into data, typically in the form an output 95.

Next, the data or output 95 is received by the display 74, typically through an electrical connection between the display 74 and the controller 72. The display 74 then processes the output 95, typically through a processing unit (not shown), and generates the visual clearance indication 78 that can be displayed in the viewing area 76 of the display 74.

Finally, this visual clearance indication 78 may be viewed by the caregiver or individual within the viewing area 76 and provides information to the caregiver or individual regarding the presence, or absence, of an object 73 within the clearance zone C1.

In certain further embodiments, the lift mechanism 26 is also coupled to the controller 72, typically via an electrical connection. In these embodiments, the controller 72 may be configured to generate a separate output 96 that is received by the lift mechanism 26 that is based the received clearance signal or signals CS corresponding to the detected clearance. The lift mechanism 26 may process the received output 96 to control the functionality of the lift mechanism 26. For example, in certain embodiments, when an object 73 is detected in the clearance zone C1 by one or more of the clearance sensors 70, the lift mechanism 26 may be disabled or otherwise configured to prevent a caregiver or individual from lowering the frame 28 relative to the floor surface 17 until the object 73 is removed from the clearance zone C1.

In still further embodiments, as also illustrated in FIG. 8 and in FIGS. 1A and 1B, the indication system 100 may also include an activator button 111 that is electrically coupled to the controller 72. In these embodiments, the actuation of the activator button 111 may be coordinated to generate the visual clearance indication 78 in the viewable area 76. More specifically, in certain embodiments, in order to view the detected clearance, the caregiver or individual would actuate the activator button 111 to activate the indication system 100, or one or more components of the indication system (i.e., activate the clearance sensors 70, and/or the controller 72, and/or the display 74, 74A and/or the lift mechanism 26), to allow the visual clearance indication 78 to be generated and viewable in the viewing area 76. In the absence of actuation by the activator button 111, the indication system 100 would be deactivated, thus conserving power and preventing the display of the visual clearance indication 78.

Referring now to FIGS. 4-7, the visual clearance indication 78 viewable within the viewing area 76 of one of more of the displays 74 is illustrated in different alternative forms.

Figure 4:
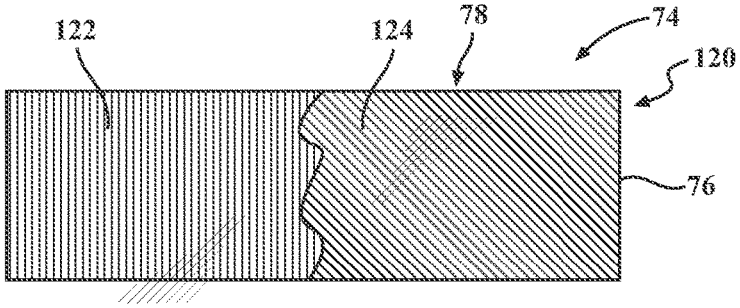
FIGS. 4-7 illustrate alternative embodiments of generated visual clearance indications in the viewable area of the first or the second display coupled to the patient support apparatus of FIGS. 1A and 1B.

Referring first to FIG. 4, one embodiment of the visual clearance indication 78 viewable within the viewing area 76 of display 74 is provided. In this embodiment, the visual clearance indication 78 is in the form of at least one visual indicator 120 (such as a colored light or colored light emitting diode (LED)), here shown as a single visual indicator 120, that is changeable in color between a first color 122 and a second color 124 according to the detected clearance corresponding to the clearance signal generated by the one or more sensors 70 within the clearance zone C1. In this embodiment, the respective at least one visual indicator 120 is selectively illuminated or displayed in either the first color 122 or the second color 124 according to the output 95 sent from the controller 72 to the display 74, which is based upon the detected clearance corresponding to the clearance signal CS generated by the one or more sensors 70 within the clearance zone C1.

Stated another way, the first color 122 is illuminated or displayed when the clearance sensors 70 do not detect the presence of an object 73 in the clearance zone C1, whereas the second color 124 is illuminated or displayed when the clearance sensors 70 detect the presence of an object 73 in the clearance zone C1.

Figure 5:
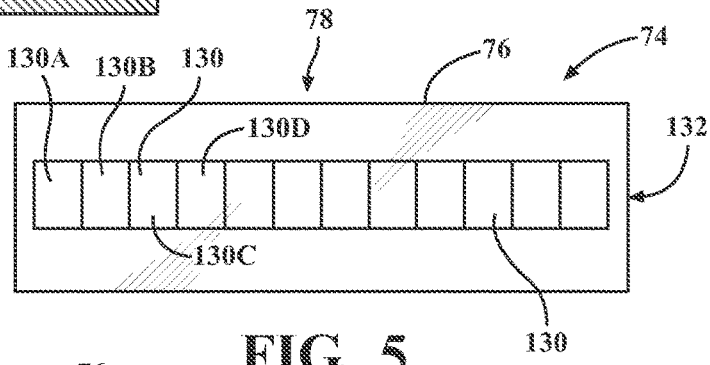
Figure 6:
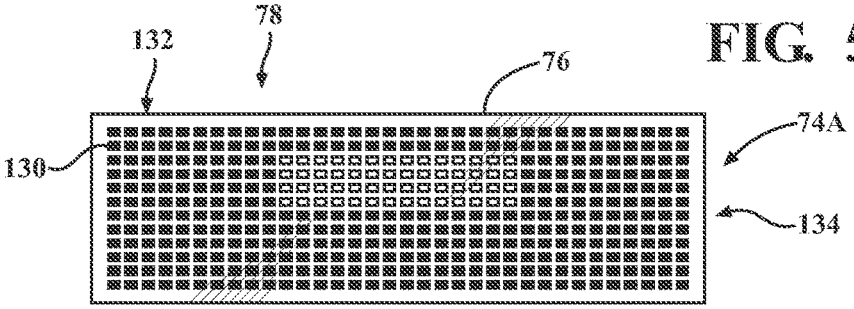

Referring next to FIGS. 5 and 6, additional embodiments of the visual clearance indication 78 viewable within the viewing area 76 of display 74 are provided. In these embodiments, the visual clearance indication 78 is in the form of at least one visual indicator 130 which, as opposed to changing color in accordance with the embodiments according to FIG. 4, either illuminate or do not illuminate according to the output 95 sent from the controller 72 to the display 74, which as noted previously is based upon the detected clearance corresponding to the clearance signal CS generated by the one or more clearance sensors 70 within the clearance zone C1. Stated another way, in one variation, the one or more visual indicators 130 illuminate when an object 73 is detected by the sensors 70 in the clearance zone C1, and conversely do not illuminate when an object 73 is not detected by the clearance sensors 70 in the clearance zone C1. In an alternative variation, the opposite occurs, wherein the one or more visual indicators 130 do not illuminate when an object 73 is detected by the sensors 70 in the clearance zone C1, and conversely do illuminate when an object 73 is not detected by the clearance sensors 70 in the clearance zone C1.

In the embodiment as illustrated in FIG. 5, the at least one visual indicator 130 includes more than one visual indicator 130 (i.e., an array of visual indicators 130) that are respectively displayed in the viewing area 76 of the display 74 in a single row 132. In this embodiment, each one of the individual visual indicators 130 may selectively be illuminated or not illuminated (i.e., selectively activated or not activated) according to the output 95 sent from the controller 72 to the display 74 based on the detected clearance within the clearance zone C1, or alternatively within a selected portion of the clearance zone C1.

For instance, each one of the visual indicators 130 of the row 132 may be coordinated to the clearance in a particular length, defined in the longitudinal or x-direction, of the clearance zone C1. By way of example, when the clearance sensors 70 are in the form of an emitter 80A and detector 82A that are coupled to inner surfaces 35, 37 of the respective head section 25 and foot section 27 of the base 22 as noted above and shown in FIG. 2, the detected clearance of the particular length of the clearance zone C1 corresponds to the volume of the emitted signal ES1 extending between a respective coordinated pair of the emitter 80A and detector 82A. As such, the illumination of a first one 130A of the respective visual indicators 130 in the row 132 corresponds to the detected clearance in the predefined portion PP of the clearance zone C1 corresponding to the emitted signal ES1 extending between a respective coordinated first pair of the emitter 80A and detector 82A. Similarly, the illumination of a second one 130B of the respective visual indicators 130 adjacent to the first one 130A displayed in the row 132 corresponds to the detected clearance in the predefined portion PP of the clearance zone C1 corresponding to the emitted signal ES1 extending between a respective coordinated second adjacent pair of the emitter 80A and detector 82A. The illumination of the third one 130C (adjacent to the second one 130B), and the fourth one 130D (adjacent to the third one 130C), of the visual indicators 130 displayed in the row 132 would similarly correspond to the detected clearance in the predefined portion PP of the clearance zone C1 corresponding to the emitted signal ES1 extending between a respective coordinated third and fourth adjacent respective pairs of the emitter 80A and detector 82A, and so on. Accordingly, the illumination of less than all of the visual indicators 130 in the row 132 would indicate the detected clearance corresponding to the presence, or absence, of an object 73 within each respective corresponding predefined portions PP of the clearance zone C1 extending in the x-direction between the inner surfaces 35, 37 of the respective head section 25 and foot section 27 of the base 22. See also the illustration of the visual indicators 130 in FIG. 2.

In the embodiment illustrated in FIG. 5, and as described above, the total number of visual indicators 130 provided in the row 132 corresponds to the respective number of pairs of emitters 80A and detectors 82A provided in FIG. 2. Alternatively, the total number of visual indicators 130 provided in the row 132 is different than the respective number of pairs of emitters 80A and detectors 82A provided in FIG. 2. For example, the number of visual indicators 130 may be in some multiple of the number of pairs of emitters 80A and detectors 82A, such as twice as many or half as many, or may be present in non-multiple amounts.

In a related embodiment (not shown), the total number of visual indicators 130 provided in the row 132 of the display 74 could alternatively be coordinated to the respective number of pairs of emitters 80B and detectors 82B, as opposed to the respective pairs of emitters 80A and 80B. In still further variations, the total number of visual indicators 130 provided in the row 132 coordinated to the respective number of pairs of emitters 80B and detectors 82B could be utilized with the second display 74A. Alternatively, the total number of visual indicators 130 provided in the row 132 is different than the respective number of pairs of emitters 80B and detectors 82B provided in FIG. 2. For example, the number of visual indicators 130 may be in some multiple of the number of pairs of emitters 80B and detectors 82B, such as twice as many or half as many, or may be present in non-multiple amounts.

As such, in these related embodiments (not shown), each respective one 130 of the at least one visual indicators 130 is thus configured to illuminate, or not illuminate, based upon the detected clearance in a particular width, defined in the lateral or y-direction, of the clearance zone C1, as opposed to illuminating based upon the detected clearance in a particular length as described above. Thus, by way of this alternative example, the detected clearance of the particular width of the clearance zone C1 corresponds to the volume of the emitted signal ES2 extending between a respective coordinated pair of the emitter 80B and detector 82B.

The illumination of less than all of the visual indicators 130 in the row 132 would also allow a caregiver or individual the ability to quickly assess if there's any object 73 beneath the base 22, or a portion of the support structure 20 in the clearance zone C1, that would prevent their ability to place the legs 73 of the OBT 71 or patient lift and/or to assess where best to place the legs 73 if some predefined portions PP or grids 105 or zones 110 are obstructed, while others are not.

In a further related embodiment illustrated in FIG. 6, the visual clearance indication 78 is coordinated to both sets of respective pairs of emitters 80A, 80B and associated detectors 82A, 82B and in particular is coordinated to the grid 105 of emitted signals ES including both the emitted signals ES1 and ES2 described in particularity with respect to FIG. 2A above.

Accordingly, in this embodiment, a plurality of visual indicators 130 are provided in the viewing area 76 which are coordinated into a series of rows 132 and columns 134. In one embodiment, as illustrated in FIG. 6, the total number of visual indicators 130 in each respective row 132 corresponds to the number of pairs of emitters 80B and detectors 82B, whereas the total number of visual indicators 130 is a respective column 134 corresponds to the number of pairs of emitters 80A and detectors 82A. In an alternative variation of this embodiment (not shown), the opposite is true, in which the total number of visual indicators 130 in each respective row 132 corresponds to the number of pairs of emitters 80A and detectors 82A, whereas the total number of visual indicators 130 is a respective column 134 corresponds to the number of pairs of emitters 80B and detectors 82B. Of course, similar to as described above, the total number of visual indicators 130 in the respective rows 130 and/or columns 134 may also vary in number to the number of pairs of emitters 80A and detectors 80B and/or the number of pairs of emitters 80B and detectors 80B.

In either variation, each respective one visual indicator 130 of the plurality of visual indicators 130, defined by a particular row 132 and a particular column 134, preferably corresponds to the location of a respective one of the plurality of intersecting zones 110 in the grid 105 as illustrated in FIGS. 2 and 2A. Accordingly, the illumination or non-illumination of the respective one visual indicator 130 represents the detected clearance in the predefined portion PP of the grid 105 corresponding to the one intersection zone 110 as determined by the receipt of the emitted signals ES1, ES2 passing through the one intersection zone 110 by the respective detectors 82A, 82B.

In certain embodiments, the illumination of each respective one 130 of the plurality of visual indicators 130 occurs when each of the emitted signals ES1 and ES2 corresponding to a single intersecting zone 110 are received by the respective detector 82A, 82B associated with these signals, and are indicative of the absence of an object 73 (i.e., a clearance indication) detected at the location of the single intersection zone 110. Conversely, the interruption of either emitted signal ES1 or ES2, in this embodiment, would prevent the illumination of the respective one visual indicator 130. The illumination of multiple visual indicators 130 in respective rows 132 and columns 134 in the viewable area 76 aids the caregiver in determining the presence, and location, of one or more objects in the clearance zone C1 without the need to bend over to visually inspect the clearance zone C1.

The visual indicators 130, as illustrated in FIGS. 5 and 6, may take on many forms. For example, the visual indicators 130 may be individual lights, such as LED's and similar light devices, as shown in FIG. 5. Alternatively, the visual indicators 130 may be light bar indicators that are generated on a display screen or any other form of visual indicator that is visible by the caregiver or operator, as shown in FIG. 6. Still further, while the embodiments describes the visual indicators 130 as being illuminated or not illuminated, alternative embodiments are envisioned in with the visual indicators change color, or change brightness or intensity, or provide some other sensory indication perceptible by the caregiver.

Figure 7:
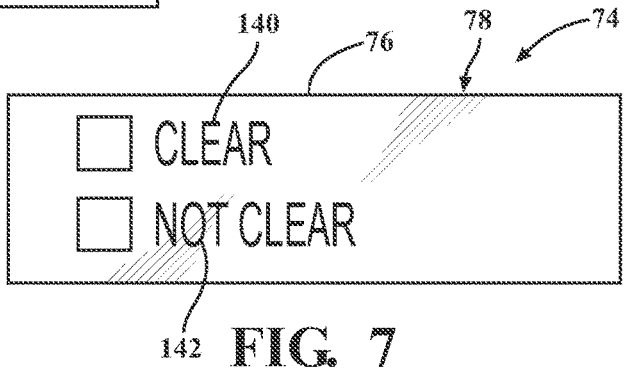

Referring next to FIG. 7, another embodiment of the visual clearance indication 78 viewable within the viewing area 76 of display 74, 74A is provided in which a digital display is utilized. Thus, as opposed to displaying the detected clearance on the basis of color as in FIG. 4 or on the basis of visual indicators being illuminated or not illuminated as in FIGS. 5 and 6, the embodiment of FIG. 7 displays words or symbols in digital form that correspond to the detected clearance within the clearance zone C1.

By way of one non-limiting example as illustrated in FIG. 7, the display 74 illustrated is configured to generate the word "CLEAR" 140 within the viewable area 76 corresponding to the output 95 received by the controller 72 when the clearance sensors 70 do not detect an object 73 within the clearance zone C1, and generate the phrase "NOT CLEAR" 142 corresponding to the output 95 received by the controller 72 when the clearance sensors 70 detect an object 73 within the clearance zone C1. Of course, other indicia, such as other words or phrases other than "CLEAR" or "NOT CLEAR" may be displayed in the viewing area 76 that correspond to the detected clearance and provide an indication regarding the available clearance in the clearance zone C1. In further alternatives, the digital display 74 illustrated is configured to generate a quantitative measurement. For example, the digital display 74 illustrated can be in the form of a number corresponding to a clearance measurement within the clearance zone C1, such as, for example, the distance an object is located from a particular clearance sensor 70.

In still a further embodiment, corresponding to when the clearance sensors are cameras 90, such as illustrated in FIG. 3, the visual clearance indication 78 viewable in the viewing area 76 of the display 74, 74A may be in the form of a digital image of the clearance zone C1, a color corresponding to a detected object or clearance in the clearance zone C1, or a video of the clearance zone C1.

In still further embodiments, as also illustrated in FIGS. 1A and 1B, one or more clearance sensors 70 may also be coupled to a bottom surface of one or more of the side rails 44 that is configured to detect the clearance between the side rail 44 and the floor surface 17. These clearance sensors 70 may be coupled to the controller 72, or a separate controller (not shown), which in turn are coupled to the display 74. Preferably, the display 74 is a separate display coupled to the respective side rail 44. In this way, a caregiver or operator can confirm clearance beneath the side rail 44 prior to lowering the side rail 44 from the raised position to the lowered position.

In still further embodiments, the patient support apparatus 15 is formed with a base in a form different than the base 22 illustrated in FIGS. 1A and 1B. For example, as described in U.S. Pat. No. 8,256,048, which is herein incorporated by reference, the apparatus 15 may be in the form of a long-term care bed, wherein legs of the bed are connected laterally by caster tubes (that generally correspond to the head section 25 and foot section 27 of the base 22). Accordingly, in this apparatus, there is no equivalent first and second side section 29, 31. In such an embodiment, it is contemplated that clearance sensors 70 may be incorporated into one or both of the caster tubes in this long-term care bed and function in accordance with the clearance sensors described in FIGS. 1-7 above (such as in the form of emitter 80/detectors 82 or cameras 90 as described above).

The embodiments described herein allow caregivers or individuals to quickly and easily determine the clearance in the clearance zone C1 without requiring the caregiver to physically bend over to view the clearance between the base 22 and the floor surface 17. In this way, the caregiver can quickly and easily ascertain whether an object 73, such as the legs 71 of an OBT or patient lift, can be inserted between the base 22 and the floor surface 17 without otherwise contacting the support structure 20 of the bed or another object 73 within the clearance zone C1. In addition, the caregiver can quickly and easily determine whether the operation of the lift mechanism 26 to lower the patient support surface 43 would result in contacting the object 73 positioned within the clearance zone C1. Such contact could result in damage to the patient support apparatus 15 or the object 73, or both. Still further, the clearance detected by the one or more clearance sensors 70 of the indication system 100 of the embodiments described herein may provide a detected "dynamic clearance", in that the clearance zone C1 can change in height (i.e., corresponding to the z-direction) or volume based upon the positioning of the support structure 20, or portions thereof, relative to the floor surface 17, or of the side rails 44 relative to the floor surface 17 as it relates to the lowering of the side rails 44, or to the relative placement of the one or more clearance sensors 70 along the support structure 20. For instance, when the clearance sensors 70 are connected to the frame 28 and/or to the patient support deck 30 to detect a clearance zone beneath the frame 28 and/or the patient support deck 30, then the clearance zone may change in height (z-direction) and volume based on raising or lowering of the frame 28 and/or articulation of the deck sections of the patient support deck 30. Still further, as noted above, the detected clearance can be performed in a continuous manner, or upon actuation of the display 74 by the caregiver or operator, as desired.

It will be further appreciated that the terms "include," "includes," and "including" have the same meaning as the terms "comprise," "comprises," and "comprising."

Several embodiments have been discussed in the foregoing description. However, the embodiments discussed herein are not intended to be exhaustive or limit the invention to any particular form. The terminology which has been used is intended to be in the nature of words of description rather than of limitation. Many modifications and variations are possible in light of the above teachings and the invention may be practiced otherwise than as specifically described.

What is claimed is:

1. A patient support apparatus for being positioned on a floor surface, the patient support apparatus comprising:

a support structure comprising a base, a frame, and a patient support surface adapted to support a patient;

a lift mechanism to move said frame relative to said base; and an indication system coupled to said support structure, said indication system comprising:

one or more clearance sensors coupled to said support structure, each of said one or more clearance sensors configured to detect clearance within a clearance zone defined between said patient support surface and the floor surface below and within a perimeter defined laterally and longitudinally by said frame, said one or more clearance sensors also configured to generate one or more clearance signals corresponding to detected clearance within a plurality of predefined portions of said clearance zone coordinated in a row and having respective predefined dimensions;

a controller coupled to said one or more clearance sensors and configured to receive said one or more clearance signals and generate an output based upon said received one or more clearance signals; and a display having a viewable area coupled to said controller and configured to receive said generated output and generate a visual clearance indication within said viewable area corresponding to said detected clearance, said visual clearance indication comprising a plurality of visual indicators coordinated in a row, wherein each visual indicator of said plurality of visual indicators corresponds to one or more predefined portions of said plurality of predefined portions with said controller configured to selectively activate one or more of said plurality of visual indicators based on said detected clearance within said corresponding one or more predefined portions to assist a caregiver in operating said lift mechanism during an absence of movement of said base along the floor surface, wherein said plurality of predefined portions are arranged in a grid with each of said plurality of predefined portions having a predefined length and a predefined width such that selective activation of one or more of said plurality of visual indicators is based upon a position of said detected clearance within said grid.

2. The patient support apparatus of claim 1, wherein said plurality of visual indicators are changeable in color between a first color and a second color based on said detected clearance with said controller being configured to selectively change said color from said first color to said second color based on said detected clearance.

3. The patient support apparatus of claim 1, wherein said plurality of predefined portions of said clearance zone extend in a lateral direction relative to said base.

4. The patient support apparatus of claim 1, wherein said plurality of predefined portions of said clearance zone extend in a longitudinal direction relative to said base.

5. The patient support apparatus of claim 1, wherein said plurality of visual indicators are coordinated in a plurality of rows and a plurality of columns, wherein each single row of said plurality of visual indicators corresponds to a first predefined portion of said clearance zone extending in a lateral direction, wherein each single column of said plurality of visual indicators corresponds to a second predefined portion of said clearance zone extending in a longitudinal direction, and with said controller configured to selectively activate one or more of said plurality of visual indicators based on said detected clearance of an intersecting zone defined by said first and second predefined portions.

6. The patient support apparatus of claim 1, wherein said generated visual clearance indication comprises a digital readout.

7. The patient support apparatus of claim 1, wherein said base comprises a head section, an opposing foot section, and a pair of opposing side sections connecting said head section to said foot section, wherein said clearance zone is further defined beneath said base and between said head section, said opposing foot section, and said opposing side sections.

8. The patient support apparatus of claim 7, wherein said one or more clearance sensors are coupled to one of said head section or said foot section, each of said one or more clearance sensors configured to detect clearance in a predefined portion of said clearance zone extending in a longitudinal direction between said head section and said foot section.

9. The patient support apparatus of claim 7, wherein said one or more clearance sensors are coupled to one of said opposing side sections, each of said one or more clearance sensors configured to detect clearance in a predefined portion of said clearance zone extending in a lateral direction between said opposing side sections.

10. The patient support apparatus of claim 1, wherein each of said one or more clearance sensors comprises an emitter and an associated detector coupled to said controller, said emitter configured to generate a signal that is detectable by said associated detector to detect clearance within a respective predefined portion of said clearance zone defined between a respective pair of said emitter and said associated detector.

11. The patient support apparatus of claim 1, wherein said one or more clearance sensors comprise a plurality of emitters and a plurality of associated detectors coupled to said controller, each of said plurality of associated detectors is configured to generate a clearance signal corresponding to detected clearance within a respective predefined portion of said clearance zone.

12. The patient support apparatus of claim 11, wherein said display is further configured to generate a separate visual clearance indication corresponding to said detected clearance of each of said respective predefined portions of said clearance zone.

13. The patient support apparatus of claim 1, wherein said one or more clearance sensors comprises a camera.

14. The patient support apparatus of claim 1, wherein said indication system further comprises an activator button coupled to said controller and configured to activate said one or more clearance sensors and said display to generate said visual clearance indication.

* * * * *